US006313730B1

(12) United States Patent
Ohara et al.

(10) Patent No.: US 6,313,730 B1
(45) Date of Patent: Nov. 6, 2001

(54) LINEAR SLIDING VARIABLE RESISTOR

(75) Inventors: Tatsuya Ohara; Masahiro Asano, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/707,684

(22) Filed: Nov. 7, 2000

(30) Foreign Application Priority Data

Nov. 19, 1999 (JP) ..... 11-329295

(51) Int. Cl.[7] ..... H01C 10/38
(52) U.S. Cl. ..... 338/176; 338/33; 338/202
(58) Field of Search ..... 338/33, 160, 176, 338/194, 202

(56) References Cited

U.S. PATENT DOCUMENTS 3,364,454 * 1/1968 Froebe ..... 338/176
4,053,865 10/1977 Brown, Jr. .
4,213,112 * 7/1980 Alman et al. ..... 338/176
4,473,814 * 9/1984 Blessing ..... 338/176
4,479,107 * 10/1984 Bleeke ..... 338/176

FOREIGN PATENT DOCUMENTS 11-23210 1/1999 (JP) .

* cited by examiner

*Primary Examiner*—Karl D. Easthom
(74) *Attorney, Agent, or Firm*—Brinks Hofer Gilson & Lione

(57) ABSTRACT

A linear sliding variable resistor comprises a case with a through hole; an operating shaft inserted in the through hole and axially movably locked; an insulated board located in the case and having an electrically conductive pattern on the surface thereof; a sliding contact which slides on the pattern; and a sliding contact retainer which retains the sliding contact and is fixed on the operating shaft. The sliding contact retainer is provided with a pair of snap legs and a retaining portion having a U-sectional recess; and the operating shaft is held by the recess of the retaining portion and the snap legs.

5 Claims, 2 Drawing Sheets

LINEAR SLIDING VARIABLE RESISTOR

BACKGROUND OF THE INVENTION

1. Field of the Invention

This invention relates to a linear sliding variable resistor for use in a position detecting sensor for example.

2. Description of Related Art

The general structure of a linear sliding variable resistor known as a conventional example is shown in the side sectional view of FIG. 5. The linear sliding variable resistor is comprised of a case 23 having a through hole 21 in one end face and an opening 22 in the opposite side surface, an operating shaft inserted extending outward from inside of the case 23 through the through hole 21, an insulated board 25 provided with an unillustrated electrically conductive pattern of resistance on the surface, a sliding contact 26 sliding on the electrically conductive pattern, a sliding contact retainer 27 holding the sliding contact 26 and secured on the operating shaft, a cover 28 attached at the opening 22 of the case 23, and a spring 29 mounted between the cover 28 and the sliding contact retainer 27.

The linear sliding variable resistor of the above-described configuration is assembled by the following procedure. First, the insulated board 25 is inserted from the opening 22 side of the case 23, then the operating shaft 24 is inserted into a through hole 30 provided in the sliding contact retainer 27. Subsequently, the operating shaft 24 and the sliding contact retainer 27 are inserted into the case 23 from the opening 22 side of the case 23, with its forward end being inserted into the through hole 21. Next, the spring 29 is inserted into the operating shaft 24 until the spring 29 comes into contact with the sliding contact retainer 27. Then, the cover 28 is attached to the case 23 with the rear end of the operating shaft 24 inserted into the through hole 31.

The sliding contact retainer 27 was a few millimeter small square part. Assembling the above-described conventional example of linear sliding variable resistor required time and labor, centering much of attention in supporting the small part firmly and inserting the operating shaft 24 into the through hole 30 measuring 1 to 2 mm in diameter, which is nearly the same as the operating shaft 24.

SUMMARY OF THE INVENTION

In view of the above-described circumstances, it is an object of this invention to provide an easy-to-assemble linear sliding variable resistor in which a sliding retainer can be easily and firmly fixed on the operating shaft without increasing the component count.

To achieve the object stated above, the linear sliding variable resistor of this invention comprises a case having a through hole, an operating shaft inserted in the through hole and axially movably held, an insulated board arranged in the case and having an electrically conductive pattern on the surface, a sliding contact sliding on the pattern, and a sliding contact retainer for retaining the sliding contact and fixed on the operating shaft; the sliding contact retainer having a pair of snap legs and a retaining section having a U-sectioned recess; and the operating shaft being held by the recess in the retaining section and the snap leg.

According to the above-described configuration, the operation for fixing the sliding contact retainer to the operating shaft needs just pushing the operating shaft into the recess of the bearing, thereby enabling a much easier assembling operation than conventional ones.

Furthermore, the operating shaft in this invention has a small-diameter portion; and the recess of the retainer is partly provided with stepped portions. The stepped portions fit the small-diameter portion, so that the sliding contact retainer may follow the axial movement of the operating shaft, thereby enabling reliable restriction of the axial direction of the sliding contact retainer and the operating shaft.

In this invention, the recess stated above is open in the opposite side of the surface of the sliding contact retainer on which the sliding contact is retained. Therefore, the sliding pressure of the sliding contact acts in a direction in which the sliding contact retainer is pressed against the operating shaft, thereby insuring more reliable retaining. The sliding contact retainer, having a simple shape of bilateral similarity, is advantageous for fabrication.

Furthermore, it is desirable for this invention that the retaining section is provided on either side of the snap leg along the axial direction of the operating shaft, and the bottom surface of the recess of the retaining section is in contact with the peripheral surface of the operating shaft. Because of this configuration, the positional relation between the operating shaft and the sliding contact retainer is properly kept, firmly securing the sliding contact retainer on the operating shaft.

DESCRIPTION OF THE PREFERRED EMBODIMENTS

Figure 1:
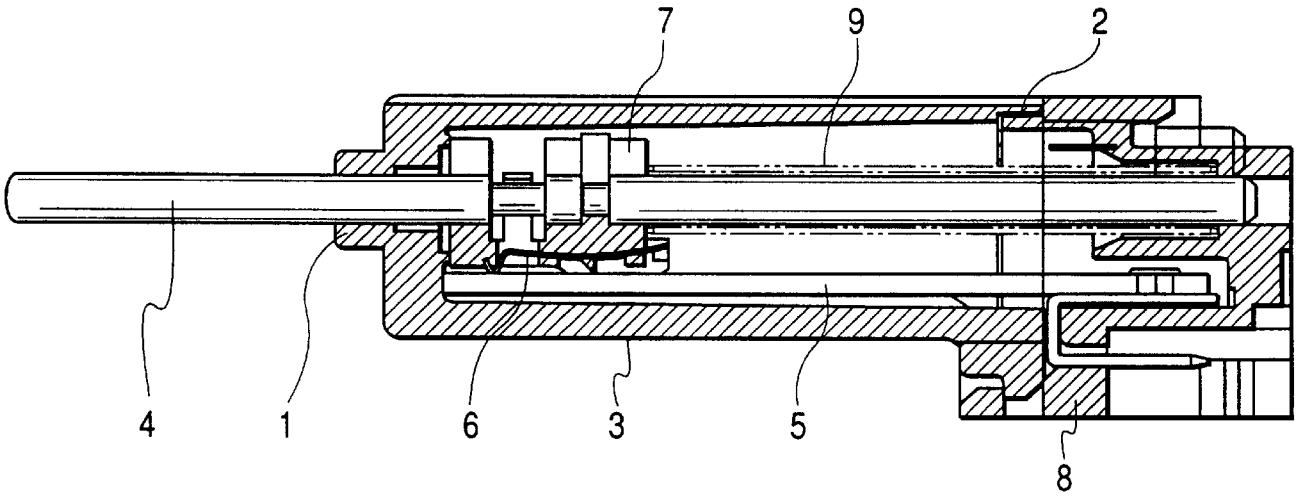
FIG. 1 is a side sectional view showing the general structure of a linear sliding variable resistor of this invention.

Preferred embodiments of a linear sliding variable resistor according to this invention will be explained with reference to FIG. 1 to FIG. 4. FIG. 1 is a sliding sectional view showing the general structure of the linear sliding variable resistor of this invention. The variable resistor is basically almost the same in configuration as a conventional variable resistor shown in FIG. 4, comprising a case 3 having an through hole 1 in one end face and an opening 2 in the opposite side surface, a cylindrical operating shaft 4 inserted in such a position that it protrudes out of the case 3 through the through hole 1, an insulated board 5 located in parallel with the operating shaft 4 and provided with an electrically conductive pattern of resistance on the surface thereof, a sliding contact sliding on the electrically conductive pattern, a sliding contact retainer 7 of a synthetic resin secured on the operating shaft to retain the sliding contact 6, a cover 8 attached at the opening 2 of the case 3, and a spring 9 located between the cover 8 and the sliding contact retainer 7.

Figure 2:
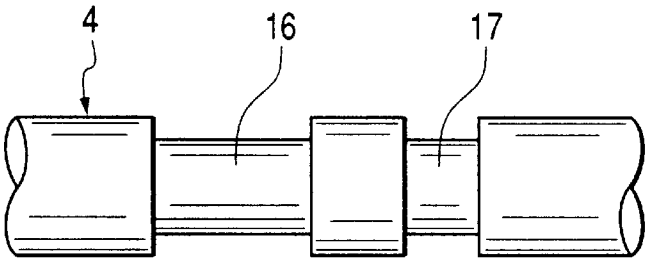
FIG. 2 is an enlarged view showing a part of an operating shaft of the linear sliding variable resistor of this invention.
Figure 3:
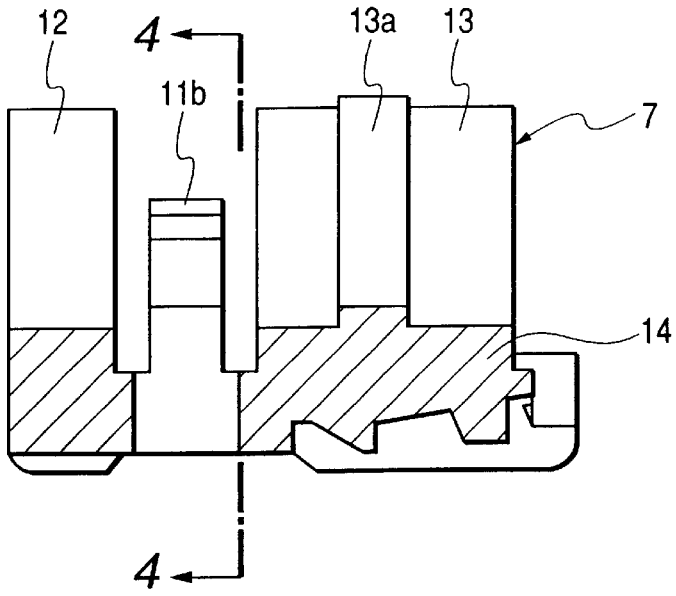
FIG. 3 is an enlarged sectional view of a major portion of a sliding contact retainer of this invention.

FIG. 2 is an enlarged view showing a part of the operating shaft 4; FIG. 3 is an enlarged sectional view of a major portion of the sliding contact retainer 7 (without the sliding contact 6); and FIG. 4 is a sectional view taken along line 4—4 in FIG. 3.

Figure 4:
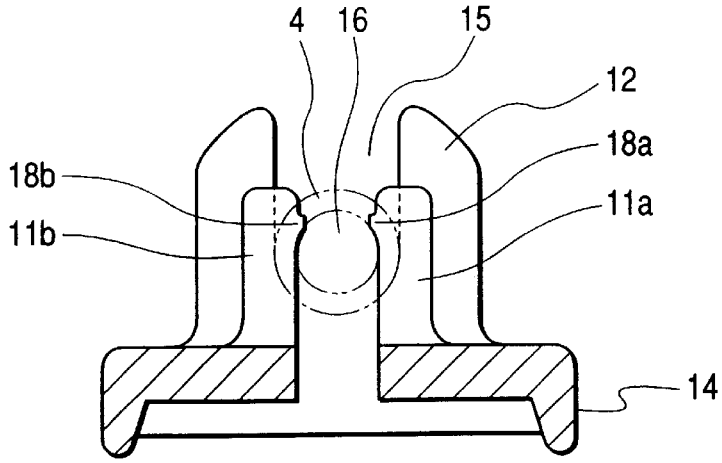
FIG. 4 is a sectional view of the sliding contact retainer taken along line 4—4 of FIG. 3.
Figure 5:
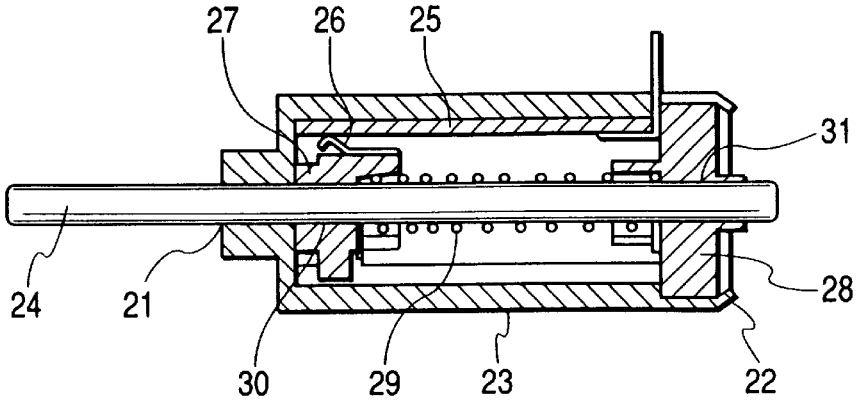
FIG. 5 PRIOR ART
FIG. 5 is a side sectional view showing the general structure of a conventional linear sliding variable resistor.

In FIGS. 3 and 4, the sliding contact retainer 7 has a pair of snap legs 11*a* and 11*b* which open upward in the drawings, and semi-cylindrical retaining sections 12 and 13 which are open in a U shape on either side in the axial direction. The retaining section 13 on one side is provided with a stepped portion 13*a* at the central part, protruding inward in a semi-cylindrical form. Also as shown in FIG. 2, the operating shaft 4 is provided with two small-diameter portions 16 and 17 forming steps for restricting the axial movement of the sliding contact retainer 7. The small-diameter portions are formed in a cylindrical shape. The space between the snap legs 11*a* and 11*b* is set nearly equal to the diameter of the small-diameter portion 16 which fits in the space. The width of the U-shaped recess 15 of the retaining sections 12 and 13 is also set nearly equal to the diameter of the large-diameter portion other than the small-diameter portions 16 and 17 of the operating shaft 4.

The sliding contact retainer 7 is attached to the operating shaft 4 by pressing, in a proper axial position, the operating shaft 4 from above the sliding contact retainer 7 into the recess 15 of the retaining sections 12 and 13. The retaining sections 12 and 13 come into contact with the peripheral surface of the operating shaft 4, to thereby restrict the vertical position in the drawing. A pair of projections 18*a* and 18*b* formed on the upper part of the snap legs 11*a* and 11*b* come into contact with the peripheral surface of the operating shaft 4 on the opposite side of the contact surface of the recess 15 across the axis, thereby holding the operating shaft 4. The step portion 13*a* of the retaining section 13 fits on the small-diameter portion 17 to restrict the axial movement of the operating shaft by the step provided between the large-diameter portions on both sides, thereby firmly fixing the operating shaft. That is, unlike the conventional example in which the sliding contact retainer 27 is fixed on the operating shaft 24 by inserting the operating shaft 24 into the through hole 21, the sliding contact retainer 7 of the present invention can be fixed to the operating shaft 4 simply by pressing the operating shaft 4 into the recess 15, whereby the assembling efficiency can be largely improved.

The method of assembling the linear sliding variable resistor that the operating shaft 4 fitted with the sliding contact retainer 7 thereon is inserted into the case 3 through the opening 2 of the case 3 is the same as the conventional one and therefore will not be explained.

It should be noticed that, as in the present embodiment, the depth direction of the openings at the snap legs 11*a* and 11*b* and the retaining portions 12 and 13 is not limited to be at right angles with the base portion 14, and may be a direction parallel with the base portion 14 for example in which the operating shaft 4 is pushed in laterally. However, because a reactive force from the sliding contact 6 acts toward pressing the sliding contact retainer 7 against the operating shaft 4, the sliding contact retainer 7 of the variable resistor according to this invention can be more reliably secured. Furthermore, in the present embodiment, the retaining portions 12 and 13 are formed on both sides in the axial direction of the snap legs 11*a* and 11*b*, and the bottom of the recess 15 defined between the retaining portions 12 and 13 comes into contact with the peripheral surface of the operating shaft 4, to thereby reliably maintain the positional relation between the operating shaft 4 and the sliding contact retainer 7 and accordingly to fix the sliding contact retainer 7 with higher stability.

The operating shaft 4, when axially pushed in, can axially move, being guided by both the through hole 1 of the case 3 and the through hole of the cover 8.

In this invention, as hereinabove explained, the operating shaft is held by a bearing having a U-shaped recess provided in the sliding contact retainer and a pair of snap legs; therefore the sliding contact retainer can easily be fixed simply by pressing the operating shaft into the recess of the bearing. Therefore the assembling operation can readily be performed by a simplified procedure as compared with the method of the conventional example for inserting the operating shaft into the through hole.

Furthermore, the operating shaft has a small-diameter portion, and the bearing has a stepped portion in a part of its recess; the stepped portion being fitted on the small-diameter portion, so that the sliding contact retainer may follow the axial movement of the operating shaft. Furthermore the bearing is located on both sides, in the axial direction, of the snap leg, and the sliding contact retainer in proper alignment with the operating shaft is reliably secured on the operating shaft.

What is claimed is:

1. A linear sliding variable resistor, comprising:

a case having a through hole;

an operating shaft inserted in the through hole and axially movable within said case;

an insulated board located in the case and having an electrically conductive pattern on the surface thereof;

a sliding contact which slides on the pattern; and a sliding contact retainer for retaining the sliding contact and holding the operating shaft;

wherein the sliding contact retainer is integrally formed with a pair of snap legs for snapping the sliding contact retainer to the operating shaft and a retaining portion having a U-sectional recess for aligning and engaging the operating shaft, the operating shaft being held by the pair of snap legs so that the recess of the retaining portion engages a peripheral surface of the operating shaft.

2. A linear sliding variable resistor according to claim 1, wherein the operating shaft is provided with a small-diameter portion, and the retaining portion is provided with a stepped portion having a shape complying with an outer shape of the operating shaft, the small-diameter portion being engaged by the stepped portion so that the sliding contact retainer follows the axial movement of the operating shaft.

3. A linear sliding variable resistor according to claim 1, wherein the recess opens on a side surface of the sliding contact retainer that is opposite a side surface of the sliding contact retainer on which the sliding contact is attached.

4. A linear sliding variable resistor according to claim 1, wherein the sliding contact retainer has two retaining portions, the two retaining portions being mounted on both sides of the snap legs along the axis of the operating shaft, and wherein the inner bottom of each of the recesses of the two retaining portions is in contact with the peripheral surface of the operating shaft.

5. A linear sliding variable resistor, comprising:

a case having a through hole;

an operating shaft inserted in the through hole and axially movable within said case;

an insulated board located in the case and having an electrically conductive pattern on the surface thereof;

a sliding contact which slides on the pattern; and a sliding contact retainer for retaining the sliding contact and holding the operating shaft;

wherein the sliding contact retainer is formed of synthetic resin and is integrally formed with a base portion for holding the sliding contact, a pair of snap legs for snapping the sliding contact retainer to the operating shaft, and a retaining portion having a U-shaped sectional recess for engaging a peripheral surface of the operating shaft;

wherein the retaining portion comprises a pair of legs formed so as to protrude from the base portion toward the operating shaft with an opening disposed therebetween so as to enable the operating shaft to be inserted through the opening to engage the U-shaped sectional recess; and wherein the pair of snap legs are projected from the base portion toward the operating shaft so as to enable the operating shaft to be inserted between the pair of snap legs, each of the snap legs having a protrusion arranged such that, when a lower surface portion of the operating shaft contacts a bottom surface of the sectional recess, the protrusions of the snap legs contact an upper surface portion of the operating shaft so that the operating shaft is held between the protrusions of the snap legs and the bottom of the recess.

* * * * *